US005813543A

United States Patent [19]

Gesing et al.

[11] Patent Number: 5,813,543

[45] Date of Patent: Sep. 29, 1998

[54] METHOD OF SORTING PIECES OF MATERIAL

[75] Inventors: Adam J. Gesing; Tom Shaw, both of Kingston, Canada

[73] Assignee: Alcan International Limited, Montreal, Canada

[21] Appl. No.: 689,090

[22] Filed: Aug. 5, 1996

Related U.S. Application Data

[60] Provisional application No. 60/002,061 Aug. 9, 1995.

[51] Int. Cl.[6] ..... B07C 9/00

[52] U.S. Cl. ..... 209/653; 209/577; 209/587; 356/318; 364/478.11; 364/479.1

[58] Field of Search ..... 209/10, 579, 577, 209/587, 653; 364/568, 581, 498, 478.11, 478.17, 479.1, 479.13; 356/318, 72; 705/414, 415, 416

[56] References Cited

U.S. PATENT DOCUMENTS

| | | | |
|---|---|---|---|
| 3,203,591 | 8/1965 | Daulton et al. | 364/479.1 |
| 3,545,610 | 12/1970 | Kelly et al. | 209/579 |
| 4,317,521 | 3/1982 | Clark et al. | 209/586 |
| 4,542,808 | 9/1985 | Lloyd, Jr. et al. | 364/478.1 |
| 5,041,996 | 8/1991 | Emering | 364/550 |
| 5,042,947 | 8/1991 | Pötzschke et al. . | |
| 5,220,511 | 6/1993 | Speckhart et al. | 364/478.11 |
| 5,333,739 | 8/1994 | Stelte . | |
| 5,339,962 | 8/1994 | Commer, Jr. et al. | 209/577 |

FOREIGN PATENT DOCUMENTS

| | | | |
|---|---|---|---|
| A0 562 506 | 9/1993 | European Pat. Off. | B07C 5/34 |
| A43 40 564 | 8/1991 | Germany | B07C 5/36 |
| A2 229 809 | 10/1990 | United Kingdom | B07C 5/00 |

OTHER PUBLICATIONS

*Alloy Blending Systems* (*ABS*): Reference Manual. Keystone Systems, Inc.

*Primary Examiner*—Janice L. Krizek
*Assistant Examiner*—Thuy V. Tran
*Attorney, Agent, or Firm*—Cooper & Dunham LLP

[57] ABSTRACT

A method of sequentially sorting pieces of material in real-time into output bins where each piece has a composition defined by a plurality of control elements. Each piece is analyzed to determine the concentrations of each control element in the piece. The output bins are assigned target concentrations of the control elements that are defined by customer requirements. The method establishes a bin order used during composition checking to place each piece in a selected bin. The selected bin is the highest order bin that can accept a piece while retaining the actual concentration for each control element of the selected bin within the target concentration for each control element of the selected bin. To optimize the value of the input material to be sorted the bin order is established for each piece based on real-time sort parameters that can determine via global optimization of data from similar input material. Global optimization gives best blends of the known unique compositions and weights of the similar input material to maximize the aggregate value of the prescribed output compositions.

15 Claims, 4 Drawing Sheets

METHOD OF SORTING PIECES OF MATERIAL

CROSS REFERENCE TO RELATED APPLICATIONS

This application is a continuation of U.S. Provisional application Ser. No. 60/002,061 filed Aug. 9, 1995.

FIELD OF THE INVENTION

This invention relates to the field of sorting pieces of material into output batches having predetermined composition targets.

BACKGROUND OF THE INVENTION

Sorting pieces of material composed of aluminum (Al), non-Al metallic compositions (such as stainless steel, brass, bronze, and zinc alloys) and polymers into output batches having a predetermined composition established to maximize the value of the output is becoming an increasingly important function in the blending and reprocessing industry.

Prior art material processing systems are generally directed to either optimized bulk blending or real-time piece-by-piece sorting with no blending.

For example, a blending system developed by Keystone Systems, Inc. called the Alloy Blending System (ABS) involves the optimized blending of melting furnace composition from bulk material having known aggregate compositions. The ABS uses off-line optimization to generate the best groupings of material into output batches to maximize the aggregate value of the outputs. In particular, ABS determines, in advance of the physical sorting function, the optimal grouping of material into output batches to maximize the value of the input material.

The optimization is a relatively slow procedure due to the extensive processing required to calculate the optimum output batches. It is suitable for bulk blending applications such as melting furnace batching but it is too slow for making real-time piece-by-piece sorting decisions.

A system where optimization is used to refine sorting parameters without blending is disclosed in U.S. Pat. No. 5,333,739 (Stelte) issued on Aug. 2, 1994. Stelte teaches a method for sorting bulk material, such as scrap glass. Stelte focuses on the logic required to minimize the cross contamination of the groups of items being sorted due to the variability in the item properties and in the imprecision of the analytical method. The objective of Stelte is to sort the material by the pre-existing groups in the bulk input material and to minimize the cross contamination in the sorted groups.

To increase sorting speed, real-time sequential sorting systems have been proposed in the prior art. For example, U.S. Pat. No. 5,042,947 issued Aug. 27, 1995 entitled Scrap Detector discloses a process for analysing metal particles to determine their composition and to generate a sorting signal. However, real-time sorting systems do not approximate an off-line optimised blending solution (from the ABS, for example), since only the composition of the currently analysed piece is considered in making the real-time sorting decision.

In summary, sorting and blending systems of the prior art principally involve two methods. The first is an optimized batching procedure involving pre-processing to assign output bin designations to each piece of material having known compositions prior to the actual physical sorting process.

The second is a real-time sorting process that does not require pre-processing, but does not accurately approximate an optimized solution.

Consequently, there is a need for a method of sorting pieces of material that combines the advantages of optimized batching with the speed of real-time sequential sorting.

In particular, there is a need for a method of sorting pieces of material in which sorting parameters are established to permit real-time piece-by-piece batching that approximates global optimized results of blending pieces having different compositions to arrive at the compositions of the sorted products that are required by the customers. These output product compositions are, in general, different than the composition of any group pre-existing in the unsorted starting material.

SUMMARY OF THE INVENTION

An object of the present invention is to provide a method of sequentially sorting pieces of material that accurately approximates an optimized solution, that is one which optimally mixes different compositions to arrive at predetermined compositions of sorted product.

Another object of the present invention is to provide a method of sequentially sorting pieces of material that optimally mixes pieces having different compositions to arrive at predetermined compositions of sorted product.

Another object of the present invention is to provide a method of piece-by-piece batching that minimizes the number of output groups and minimizes the amount of input material that has to be downgraded into low value compositions.

In accordance with one aspect of the invention there is provided a method of sequentially sorting an input batch of pieces of material each having a composition defined by at least one control element, each of said pieces having a concentration for each of the control elements and a weight, said sorting being from the input batch into a plurality of output bins each assigned a target concentration for each of the control elements, pieces in each of said output bins having a cumulative aggregate weight and an aggregate concentration for each of the control elements, comprising the steps of: (a) establishing a bin order for a selected one of said pieces; (b) calculating in the bin order an aggregate composition of the output bins after the addition of said selected piece; (c) placing the selected piece in a selected bin, said selected bin being the first bin for which the new aggregate composition falls within the target concentration limits for all the control elements; and (d) repeating steps (a) to (c) for each subsequent piece in the input batch.

In accordance with another aspect of the present invention there is provided a method of sequentially sorting an input batch of pieces of material each having a composition defined by at least one control element, each of said pieces having a concentration for each of the control elements and a weight, said sorting being from the input batch into a plurality of output bins based on a plurality of predetermined sequential sort parameters, comprising the steps of: (a) establishing a bin order for a current one of said pieces; (b) calculating in the bin order an aggregate composition of the output bins after the addition of said current piece; (c) placing the current piece in a bin for which the new aggregate composition falls within limits established by the sequential sort parameters; and (d) repeating steps (a) to (c) for all subsequent pieces.

BRIEF DESCRIPTION OF THE DRAWINGS

Embodiments of the invention will be described by way of example in conjunction with the drawings in which.

DETAILED DESCRIPTION OF EMBODIMENTS OF THE INVENTION

Figure 1:
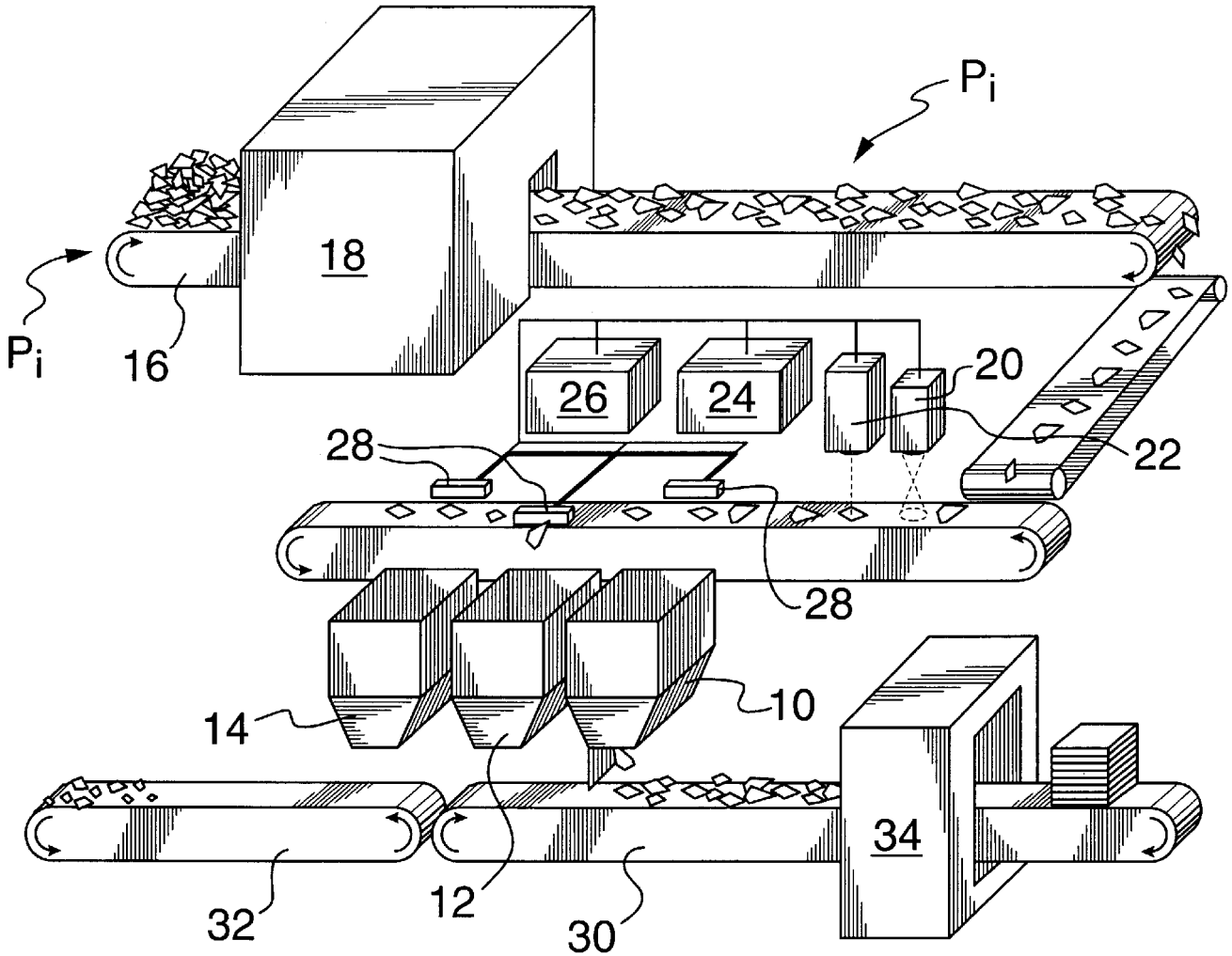
FIG. 1 illustrates a schematic representation of a sequential material sorting apparatus.

Referring to FIG. 1, numerals 10, 12, and 14 represent three output bins used to hold pieces of material of various compositions designated generally as Pi. The pieces Pi are loaded on a conveyor belt 16 that feeds the pieces Pi into a material preparation area 18 where the pieces are distributed on the conveyor 16. Each piece Pi passes under a trigger device 20 to signal a laser 22 that another piece Pi is to be analyzed.

A spectrometer 24 reads the reflections of the laser 22 and supplies the data to a computer 26. The computer 26 processes this information to direct the diverter arms 28 to place the pieces Pi into one of the output bins (10, 12 or 14). The output bins can then deposit their contents onto output conveyors 30 and 32 with conveyor 30 leading to a bailing station 34 and conveyor 32 leading to a foundry processing station (not shown).

The three output bins are illustrative only, and the actual number of output bins is dependent on the particular input batch of material being sorted and customer driven output requirements. The real-time piece-by-piece sorting methods of the present invention will be discussed in conjunction with aluminum alloy scrap. However, the methods described can readily be adapted for sorting non-aluminum compositions (such as Mg and Zn alloys, stainless steel, brass, bronze) and polymers.

Further, the methods described also apply in sorting any mixture comprised of individual pieces of material. For example, in the case of a manufacturing process that by its nature produces at some stage a mixture of different pieces that requires a sorting step to batch the input pieces in a plurality of pre-specified output groups.

The output bins 10–14 are assigned target compositions and weight levels based on customer requirements or based on information obtained from historical sorting runs for similar input material. For example, in the case of sorting aluminum, the bins 10, 12, and 14 will each have prescribed maximum levels of the six major alloying elements (Cu, Fe, Mg, Mn, Si and Mn) and a prescribed maximum (target) bin weight.

Input batches are considered similar when their associated unique composition table contains like compositions in a like weight distribution. A unique composition table summarises data on the composition of an input batch containing hundreds of thousands of individual pieces. It is a weight distribution table of unique combinations of control elements. It is the basic starting point for all off-line calculations including histogram generation and global optimization, which will be discussed in further detail hereinbelow.

Each piece Pi is analyzed sequentially in real-time to determine the following information:

(a) piece composition; and (b) piece weight (actual or estimated).

To determine the actual composition of each piece Pi a composition analysis method is used such as laser induced breakdown spectroscopy (LIBS) or X-RAY Fluorescence (XRF). For example, LIBS supplies information of the chemical composition of the six alloying elements, and on selected trace elements that may be found in large concentrations in some aluminum alloy (i.e. Li, Sn, Cr and Ni).

During real-time sorting of pieces of material it is not normally possible to weigh each individual piece Pi to obtain an actual piece weight due to the high sorting speed. However, an estimate of the piece weight is necessary for the sorting calculations. Consequently, after a historical optimized sort of a similar input batch the weight of the material in each output bin 10, 12, or 14 and the number of pieces Pi sorted in each bin is known. A calculated average piece weight can provide an estimate of the actual piece weight, which is used to drive the real-time sequential sorting process.

The inventors have found that for most practical cases of randomly shredded piece of material where piece composition is not correlated with piece weight, calculated average piece weight for the entire batch of material is sufficient because random error averages out over the large number of pieces sorted.

Specifically, sorting based on estimated piece weight, or fixed weight (for all pieces being sorted) instead of actual piece weight was found to yield very similar sorting results. Further, it was also found that the sorting results were insensitive to the fixed weight assigned to each piece.

For example, sorting with both 50 g and 200 g fixed piece weights produced the same composition error in trial experiments, equal to approximately 8%. This is a reasonable result since scaling piece weights from 50 g to 200 g does not affect how pure pieces balance impure pieces. Balancing a 200 g impure piece with a 200 g pure piece is exactly the same as balancing with 50 g pieces.

After the actual composition and estimated weight of each piece Pi have been obtained, it is assigned a bin order. The bin order is used during a composition check in which each piece Pi is compared to the output bin target composition.

Each piece Pi is placed into the first bin that can accept the piece without exceeding the maximum control element concentrations prescribed by the output bin.

The term "element" in the context of "control element" referenced in the present application refers to a constituent that is a part of a complex whole. For example, control elements can represent an actual Periodic Table element, molecular constituents, material subcomponents and the like.

The bin order for each piece Pi is established using one of the following methods:

(A) Fixed bin order giving priority to the output bin with the highest output weight target.

For example, if bins 10, 12, and 14 were assigned absolute target weights of x, y, and z (units) respectively, where x>y>z, then the bin order for each piece Pi would be [bin 10; bin 12; bin 14].

(B) Modified fixed bin order in which priority is given to the high value output bin with the highest target concentration of alloying elements.

For example, assume the same weight information recited in (A), if bin 12 has the highest target concentration of alloying elements (relative to bins 10 and 14), then the bin order for each piece Pi would be [bin 12; bin 10; bin 14]. Bin 12 takes priority ranking order over the heavier target weight of bin 10 due to the target composition of the bin.

(C) Piece specific bin order that gives higher priority to the output bin having the best match with the composition of the current piece.

For example, if the bins were assigned the following composition targets:

(a) bin 10 Cu=a, Fe=b, Mg=c, Mn=d, Si=d, Zn=d;

(b) bin 12 Cu=b, Fe=a, Mg=f, Mn=a, Si=a, Zn=a; and (c) bin 14 Cu=a, Fe=d, Mg=e, Mn=a, Si=e, Zn=a, where a–f designate control element concentrations expressed in terms of a batch weight histogram to be described hereinbelow; and a current piece being sorted, designated Pi has a composition of Cu=a; Fe=d, Mg=c, Mn=a, Si=e, Zn=c then the piece order for P1 would be [bin 14; bin 10; bin 12]. Bin 14 is listed first because the piece Pi is the best composition match (4 of 6 elements) in comparison to bin 10 (2 of 6 elements) and bin 12 (1 of 6 elements). Bin 10 is listed second because the piece Pi is a better composition match in comparison to bin 12.

(D) Piece specific bin order that is determined by a closest match with the destination distribution of a batch of similar input material when sorted according to an optimized method.

For example, assume the target compositions of the bins (10–14) as outlined above, using historical data more of the material with the composition of the current piece P1 would have been placed in bin 12 than bin 10, or bin 14. Consequently, the bin order for piece P1 would be [bin 12; bin 10; bin 14].

To provide data to the sorting methods described above, a procedure termed by the inventors' as a global optimization calculation is used to define the sort parameters for the real-time sequential sort. Using standard linear programming techniques various parameters can be defined including target bin compositions, target prime dilution/hardener levels, target optimum quantities for each output bin, and distribution of the material compositions to the output bins. The sort parameters of the global optimization procedure are used to guide the actual real time sorting methods of the present invention.

Specifically, global optimization involves a solution of a model consisting of a system of algebraic equations and nonequality constraints that permits optimization of blending of individual pieces into output bins with pre-determined composition. This model is designed to maximize total dollar value of alloys produced while maintaining customer specified composition limits in the output bins.

The material in each output bin is assigned a value in dollars per unit weight (e.g. $/lb; $/kg etc.) before optimization begins. The net dollar value of sorted material in each bin after sorting equals bin weight multiplied by bin alloy value minus cost of additional input materials such as sorted scrap, alloying hardeners and pure prime material.

In addition to the maximum net dollar value for sorted material collected in all output bins, the optimum model solution can specify distribution of each unique composition among output bins, the target bin compositions and weights for the sorted pieces of material.

A customer generally specifies the required output weight, the output composition after dilution and addition of hardeners and the current market price for each output composition. These factors are used as constraints on the global optimization calculation performed on a historical input batch of material characterized by similar weight distribution among the unique compositions. These calculations yield sorting parameters (A to C): target bin composition limits (parameter B), final bin weights (parameter C), and the distribution histogram of the material weight for each output bin (parameter A).

If the global optimization calculation is not done parameters B and C can be arbitrarily set and parameter A can be replaced by a histogram of distribution of input material weight among the control element concentration intervals (parameter D). In this case, however, there is generally no assurance that the output targets can actually be met during actual sorting.

In summary, a subset of the following sort parameters generated from the global optimization calculation are provided to the real-time sequential sorting methods of the present invention as discussed in detail hereinbelow:

Parameter A [Output Bin Histogram (wt %)]: Percent of input material element weight found at each concentration interval for all control elements, one histogram being used per output bin;

Parameter B [Composition Limit (maximum wt %)]: Composition limits, six control elements are set per bin;

Parameter C [Final Bin Weight (wt %)]: Bin weight as weight percent of input material, one final weight being set per bin; and Parameter D [Batch Weight Histogram (wt %)]: Percent of input material weight found at each concentration interval for all control elements, one histogram being defined per input batch.

Piece Specific Bin Order Using Batch Weight Histogram

Figure 2:
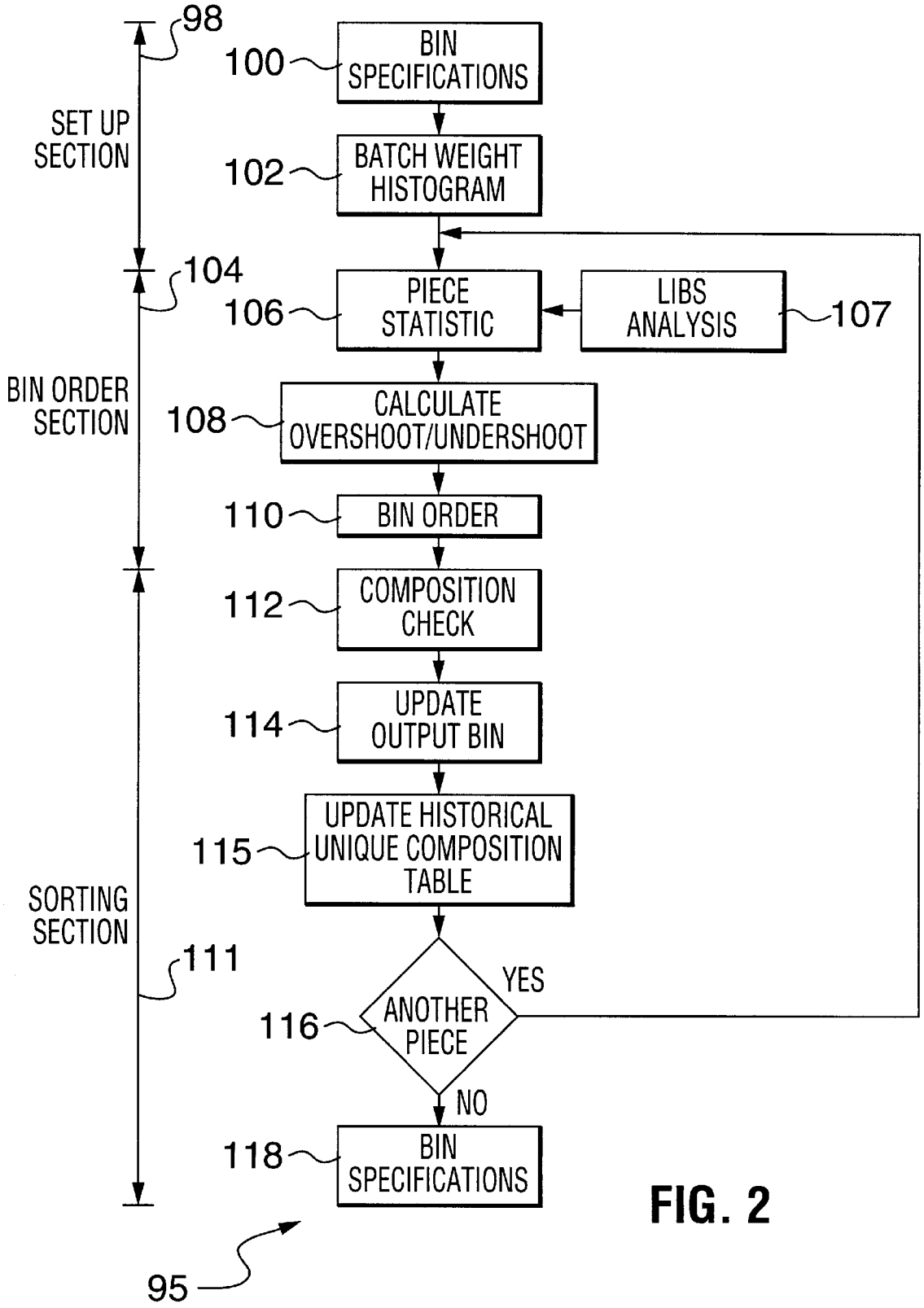
FIG. 2 represents a flow chart of a piece specific bin ordering method according to an embodiment of the present invention.

Referring to FIG. 2, a sequential sorting method 95 according to an embodiment of the present invention is illustrated in the form of a flow chart.

Setup section 98 is performed in steps 100 and 102 to prepare for the sequential real-time sorting of pieces of material.

Sorting method 95 uses parameter D (batch weight histogram) from historical batch composition data, and parameters B (bin composition limits) and C (final bin weight).

Step 102 specifies the maximum allowable bin composition limits for all control elements for the output bins before adding diluents. For example, the target compositions for bins 10, 12 and 14 could be defined as:

(a) bin 10: [A] having the following concentration limits (in relative percentages): 0.4% Fe; 1.0% Mn; 0.3% Mg; 0.2% Si; 0.04% Zn; and 0.15% Cu;

(b) bin 12: [B] having the following concentration limits: 0.26% Fe; 0.3% Mn; 1.6% Mg; 0.71% Si; 0.06% Zn; and 0.24% Cu; and (c) bin 14: residue bin with composition limits set artificially high (i.e. 99% for each control element).

The designations [A] and [B] represent specific product designations based on standards established in a particular industry. For example, the Aluminum Association would designate composition [A] as alloy 3003, and composition [B] as alloy 6061.

The target weight distribution of sorted material among output bins is also established at step 100. For example, for a 20 ton batch of input material, for the output bins 10–14 of FIG. 1, bin 10 [A] could be set to 9 tons; bin 12 [B] could be set to 4 tons; and bin 14 (residue) could be set to 7 tons.

Parameters B (output bin composition limits) and C (final bin weight) are either assigned based on customer specifications or calculated by global optimization.

The histogram file (parameter D) is read in step 102, which is used to calculate a bin order for each piece of material in an input batch. The histogram file is a cumulative table that is generated based on data from a historical table of unique compositions.

The histogram file shows how batch weight is distributed in the batch as a function of control element concentration. For example, a low iron concentration may be found in only 10% or in as high as 30% of the pieces by batch weight.

Knowing the distribution of pure pieces relative to maximum bin concentration limits makes it possible to put difficult bin compositions first in the calculated bin order each time a rare/pure piece arrives for sorting. This effectively matches pure pieces with the appropriate output bins.

A sample of a histogram file is shown in Table 1 that was generated from a batch of historical pieces (termed a historical batch) sorted prior to an actual real-time sort of a similar input batch of material. Table 1 compresses information from hundreds of thousands of historical pieces (i.e. 200,000 100 g pieces in a 20 ton batch) into a single 6 by 126 element array.

The definition of the intervals (shown in the first column of Table 1) is detailed in Appendix A. Appendix A includes a base range of 2.5 wt % that is used for all control elements and three extended ranges 5%, 10% and 27.5% used to accommodate some elements that can have much higher concentrations.

For example, interval 22 defines a minimum concentration of 0.525 wt % for Fe, Mn, Mg, Si, Cu, or Zn; interval 98 defines a minimum concentration of 2.425 wt % for Fe, Mn, Mg, Si, Cu, and Zn; interval 114 defines a minimum concentration of 3.8 wt % for Fe, Mn, and Cu; and interval 126 defines a minimum concentration of 27.5 wt % for Si.

TABLE 1

| Interval | Fe | Mn | Mg | Si | Cu | Zn |
|---|---|---|---|---|---|---|
| 1 | .72 | 48.45 | 16.66 | 4.82 | 64.32 | 51.13 |
| 2 | .80 | 49.01 | 17.56 | 6.17 | 73.07 | 53.02 |
| 3 | 1.15 | 49.30 | 24.52 | 19.87 | 73.60 | 63.90 |
| 4 | 1.44 | 49.37 | 24.83 | 25.52 | 74.21 | 64.64 |
| Rows 5 to 124 not shown. | | | | | | |
| 125 | 100 | 100 | 100 | 100 | 100 | 99.87 |
| 126 | 100 | 100 | 100 | 100 | 100 | 100 |

Each entry in Table 1 represents a cumulative batch weight (percent), one for every interval of element concentration. For example, 1.44 of interval 4 for iron (Fe) indicates that 1.44% of the historical batch weight lies at or below interval 4 for Fe; and 19.87 of interval 3 for silicon (Si) indicates that 19.87% of the historical batch weight lies at or below interval 3 for Si.

The batch weight histogram file of Table 1 is built off-line (i.e. not during actual real-time sorting) from the historical weight distribution table of unique compositions in a similar input batch (i.e. a weight distribution table of unique combinations of control elements). The batch weight histogram does not depend on the weights of the individual pieces but rather on the aggregate weights of unique compositions.

More specifically, Table 1 is generated by:

(a) adding a weight corresponding to a selected one of the unique compositions to a plurality of prescribed concentration intervals that are equal to or greater than a prescribed concentration level for a selected one of said control elements;

(b) repeating step (a) for each of the plurality of unique compositions; and (c) repeating steps (a) and (b) for each of the control elements.

During actual sequential sorting each piece is assigned a bin order that is calculated in a bin order section 104 performed in steps 106 to 110. The bin order section 104 arranges bins to minimize the change in the target bin composition. Diluting, reducing the alloying element concentrations is termed undershooting, and hardening, increasing the alloying element concentrations is termed overshooting.

For each piece to be sorted step 106 calculates the piece statistics consisting of piece composition and estimated piece weight. For example, in the case of sorting alloy scrap, the LIBS analysis, performed at step 107, would provide information about the chemical composition of the major alloying elements (Cu, Fe, Mg, Mn, Si and Mn).

Overshooting and undershooting arrays are calculated at step 108 from element concentrations transformed into batch weight levels from the histogram (Table 1) read in step 102. Specifically, the actual concentration of the control element is first converted to the concentration interval and then the cumulative weight percentage is read from the histogram Table 1. Repeating the operation for each control element one obtains the concentration vector expressed in terms of cumulative weight percentage of the batch purer than the current piece.

This effectively scales elements of different concentration ranges. The composition values are expressed in terms of % of the batch weight purer than the selected control element concentration. For example, if exactly 90% of the batch by weight is equal to or below both 1% iron (interval 41 Appendix A) and 10% silicon (interval 108 Appendix A), then these element levels after transformation to the histogram value (90%) would be considered equal.

The transformed piece composition vector is compared with the bin target composition transformed in the same way. Using these scaled compositions the amount the piece overshoots or undershoots the bin target for every element can be determined by subtracting the bin composition vector from the piece composition vector.

Positive values represent overshoot levels and negative values represent undershoot levels. At step 108 the overshoot and undershoot arrays are added for each bin over all six control elements. One bin order for overshoots is indexed in ascending order, and another bin order for undershoots is indexed in descending order.

For example, for material sorted into five bins where bin 5 is the residue bin Table 2 shows the arrays used for calculating the bin order. The array index is fixed for all pieces to be sorted, and the array contents is variable and may change with each new incoming piece.

Undershooting and overshooting are accounted for separately since overshooting by one element could be cancelled by undershooting of another element giving the same value as two elements that are very close to the target.

The principle is to select the bin composition that most closely matches piece composition based on both overshooting and undershooting.

TABLE 2

| UNDERSHOOT ARRAY (Diluting) | | | | | | OVERSHOOT ARRAY (Hardening) | | | | |
|---|---|---|---|---|---|---|---|---|---|---|
| overshoot rank | 5 | 4 | 3 | 2 | 1 | 1 | 2 | 3 | 4 | 5 | undershoot rank |
| bin | 5 | 3 | 1 | 4 | 2 | 5 | 1 | 4 | 2 | 3 | bin |

The bin order is calculated at step 110 using a table of combinations shown in Table 3. The table of combinations is used to produce bin orders for composition checking by identifying matching bin numbers between the overshoot and undershoot arrays calculated in step 108.

For example, for the five bin shoot arrays shown in Table 2, match checking starts at combination order 1 in Table 3, the lowest combination of overshoot and undershoot, and continues until all twenty-five combinations have been checked. The first matching bin number identifies the first bin in the bin order for composition checking, the second identifies the second and so on.

Specifically, undershoot rank 3 and overshoot rank 2 both correlate (see Tables 2 and 3) with bin 1 in the contents array. Therefore, bin 1 is assigned first in the bin order. Undershoot rank 2 and overshoot rank 3 both correlate with bin 4 in the contents array so bin 4 is second in the bin order. The remaining bin order is established the same way. The match for the last bin (bin 5, in present example) is not calculated because the last bin is arbitrarily assigned to the last rank.

TABLE 3

| COMBINATION ORDER NUMBER | PAIR | UNDER SHOOT RANK | OVER SHOOT RANK | MATCH | RANK IN BIN ORDER |
|---|---|---|---|---|---|
| 1 | 1 | 1 | 1 | | |
| 2 | 2 | 2 | 1 | | |
| 3 | 2 | 1 | 2 | | |
| 4 | 2 | 2 | 2 | | |
| 5 | 3 | 3 | 1 | | |
| 6 | 3 | 3 | 2 | Bin 1 | First |
| 7 | 3 | 1 | 3 | | |
| 8 | 3 | 2 | 3 | Bin 4 | Second |
| 9 | 3 | 3 | 3 | | |
| 10 | 4 | 4 | 1 | | |
| 11 | 4 | 4 | 2 | | |
| 12 | 4 | 4 | 3 | | |
| 13 | 4 | 1 | 4 | Bin 2 | Third |
| 14 | 4 | 2 | 4 | | |
| 15 | 4 | 3 | 4 | | |
| 16 | 4 | 4 | 4 | | |
| 17 | 5 | 5 | 1 | | |
| 18 | 5 | 5 | 2 | | |
| 19 | 5 | 5 | 3 | | |
| 20 | 5 | 5 | 4 | | |
| 21 | 5 | 1 | 5 | | |
| 22 | 5 | 2 | 5 | | |
| 23 | 5 | 3 | 5 | | |
| 24 | 5 | 4 | 5 | Bin 3 | Fourth |
| 25 | 5 | 5 | 5 | | |

The specific target output bin for each piece is chosen in the sorting section 111 that includes steps 112 to 118. Each piece is subjected to a composition check at step 112 that operates with fixed limits for maximum target bin concentration and follows a variable bin order recalculated on a piece-by-piece basis. Specifically, during the composition check 112 the current piece is checked to determine if it can be accepted by the output bin without exceeding the bin target composition limit for any one control element.

Piece composition and weight is tested against the bin composition and weight sequentially for each bin according to the bin order established at step 110 using the following equation:

$$C_{piece}W_{piece}+C_{bin,actual}W_{bin}<=C_{bin,max}(W_{piece}+W_{bin}) \quad . . . \quad (1)$$

where:

$C_{piece}$ is the concentration for each control element (for example, Cu, Fe, Mg, Mn, Si and Mn for aluminum pieces);

$W_{piece}$ is the estimated weight of each piece in grams;

$C_{bin,actual}$ is the actual concentration for each control element for each bin;

$W_{bin}$ is the aggregate weight of each bin; and $C_{bin,max}$ is the target (maximum) concentration for each control element for each bin.

The target weight for each output bin, established at step 100, is monitored and when the target weight for a specific bin is exceeded that bin can be "closed" and excluded from the remainder of the sort.

The composition check Equation 1 measures whether or not the piece when added to a bin causes the bin composition to exceed any one of the maximum concentration limits for control elements. The piece is added to the bin if Equation 1 is satisfied.

Composition check 112 will check the next bin in the bin order (defined in step 110) if Equation 1 is not satisfied. The last bin in the bin order is considered a residue bin, with composition limits set arbitrarily high to reject no pieces that fail to be accepted by the other bins in the bin order.

To illustrate the composition checking procedure, assume that two pieces are to be sorted into a possible three output bins. The pieces, bins and bin orders, for a theoretical example, are summarized in Table 3-1.

TABLE 3-1

| | % C1 | % C2 | % C3 | % C4 | Bin Order |
|---|---|---|---|---|---|
| Piece 1 | .23 | 0 | 1.77 | .02 | 2 1 3 |
| Piece 2 | .58 | 1.22 | 3.14 | .64 | 1 2 3 |
| Bin 1 target | .25 | .48 | 4.85 | .05 | n/a |
| Bin 2 target | .27 | .30 | 1.0 | .110 | n/a |
| Bin 3 target | 99 | 99 | 99 | 99 | n/a |

The starting values and assumptions used this example are:

(a) estimated piece weight for the pieces is 20 g;

(b) bin 1 contains pieces of material having the following aggregate statistics: $W_{bin}$=504 g; %C1=0.19, %C2=0.21, %C3=2.9, %C4=0.01; and (c) bins 2 and 3 are empty.

To determine the highest ranking bin in the bin order that can accept piece 1 the following calculations are performed:

BIN 2 (rank order 1)

CHECK 1—piece 1/element Cl $C_{piece}$=0.23

$W_{piece}$=20 g $C_{bin,actual}$=0

$W_{bin}$=0

$C_{bin,max}$=27

$$0.23\times20+0\times0<=0.27(20+0)\ 4.6<=5.4\ \text{True—proceed to check 2} \qquad \text{EQUATION 1}$$

The result of this calculation (check 1) indicates that if piece 1 were to be added to bin 2 the aggregate concentration of C1 for all pieces in bin 2 would not exceed the target concentration for element C1. Since the composition check is satisfied for element C1, the next concentration element C2 is checked.

CHECK 2—piece 1/element C2

$C_{piece}$=0

$W_{piece}$=20 g $C_{bin,actual}$=0

$W_{bin}$=0

$C_{bin,max}$=0.30

$$0\times20+0\times0<=0.30(20+0)\ 0<=6\ \text{True—proceed to check 3} \qquad \text{EQUATION 1}$$

The result of this calculation (check 2) indicates that if piece 1 were to be added to bin 2 the aggregate concentration of C2 for all pieces in bin 2 would not exceed the target concentration for element C2. Since the composition check is satisfied for element C2, the next concentration element C3 is checked.

CHECK 3—piece 1/element C3

$C_{piece}$=1.77
$W_{piece}$=20 g
$C_{bin,actual}$=0
$W_{bin}$=0
$C_{bin,max}$=1.0

1.77×20+0×0<=1.0(20+0) 35.4<=20—failed on C3, proceed to next bin in bin order EQUATION 1

The result of this calculation (check 3) indicates that if piece 1 were to be added to bin 2 the aggregate concentration of C3 for all the pieces in bin 2 would exceed the target concentration for C3. Since piece 1 cannot be placed in bin 2, the next highest ranking bin in the bin order (bin 1) must be checked to determine if bin 1 can accept piece 1.

BIN 1 (rank order 2)

CHECK 1—piece 1/element Cl $C_{piece}$=0.23
$W_{piece}$=20 g
$C_{bin,actual}$=0.19
$W_{bin}$=504
$C_{bin,max}$=0.25

0.23×20+0.19×504<=0.25(20+504) 100.36<=131 True—proceed to check 2 EQUATION 2

CHECK 2—piece 1/element C2

$C_{piece}$=0
$W_{piece}$=20 g
$C_{bin,actual}$=0.21
$W_{bin}$=504
$C_{bin,max}$=0.480

0×20+0.21×504<=0.48(20+504) 105.84<=251.52 True—proceed to check 3 EQUATION 1

CHECK 3—piece 1/element C3

$C_{piece}$=1.77
$W_{piece}$=20 g
$C_{bin,actual}$=2.9
$W_{bin}$=504
$C_{bin,max}$=4.85

1.77×20+2.9×504<=4.85(20+504) 1497<=2541.4 True—proceed to check 4 EQUATION 2

CHECK 4—piece 1/element C4

$C_{piece}$=0.02
$W_{piece}$=20 g
$C_{bin,actual}$=0.01
$W_{bin}$=504
$C_{bin,max}$=0.05

0.02×20+0.01×504<=0.05(20+504) 5.44<=26.2 True—passed on all elements, select bin 1 for piece 1 EQUATION 2

The result of these calculations (checks 1–4) indicate that if piece 1 were to be added to bin 1 all of the control element concentrations would remain within the target concentrations for bin 1.

Piece 2 can then be sorted into the highest ranking bin that can accept it using the same method detailed for piece 1. Piece 2 fails on element Cl for both bins 1 and 2 and thus is placed in the residue bin 3 (with arbitrarily high composition targets).

After a bin has accepted the piece (by satisfying Equation 1), data relating to the chosen bin is updated at step 114 to indicate that (a) another piece has been added to the bin; (b) the cumulative weight of the bin has increased accordingly; and (c) the new composition levels for the control elements.

The bin compositions are updated based on the calculated estimated piece weights defined at step 106. Consequently, for the purposes of this example, the "after" composition of bin 1 will be calculated on the basis of piece 1 being assigned an estimated weight of 20 g. This information is used to update bin statistics as shown in Table 3-2.

TABLE 3-2

| | % C1 | % C2 | % C3 | % C4 | Est. wt (g) |
|---|---|---|---|---|---|
| Piece 1 | .23 | 0 | 1.77 | .02 | 20 |
| Bin 1 Before | .190 | .210 | 2.900 | .010 | 504 |
| Bin 1 After | .192 | .202 | 2.857 | .010 | 524 |

The "after" composition values for bin 1 are calculated by multiplying the estimated piece weight and bin weight with their respective composition percentage, adding these two values and calculating the new composition percentage based on the new weight in the bin. For example, for control element Cl, "Bin 1 After" is calculated as follows:

(0.23×20+0.19×504)/(20+504)=0.192

At step 115 the unique composition table characterizing the current input scrap batch is updated by augmenting the weight corresponding to the row with the current piece composition vector or adding a new row if the current piece represents a new unique composition.

A decision step 116 returns control back to step 106 if another piece is to be sorted, or proceeds to step 118 to calculate a summary table of sorting activity if all of the pieces have been sorted.

Piece Specific Bin Order Using Output Bin Histogram

Figure 3:
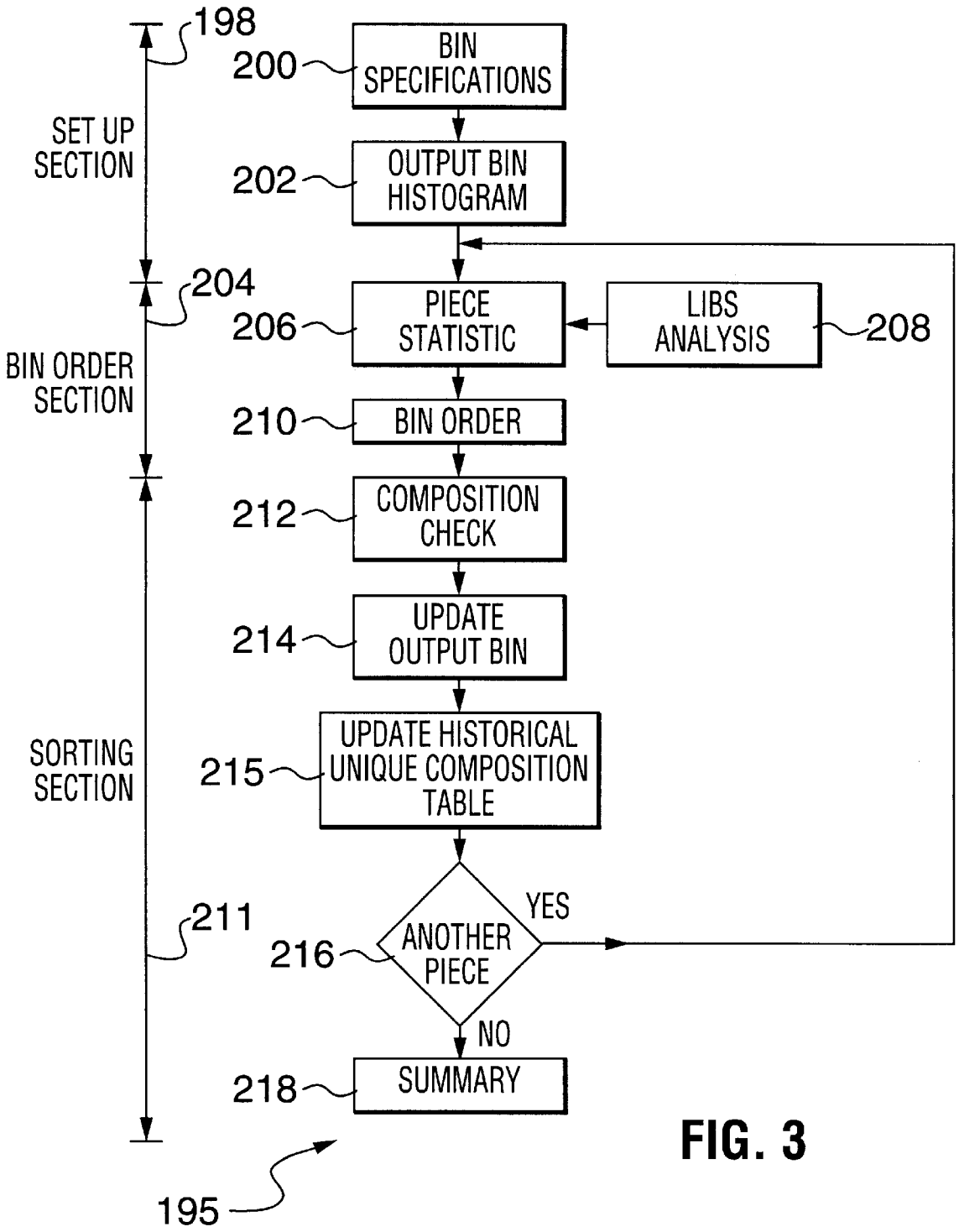
FIG. 3 represents a flow chart of a piece specific bin ordering method according to another embodiment of the present invention.

Referring to FIG. 3, a sequential sorting method 195 according to another embodiment of the present invention is illustrated in the form of a flow chart.

Sorting method 195 is an improvement over method 95 (FIG. 2) in that it uses the information on how the global optimization calculation distributed similar material among the output bins to guide the best choice of the bin order. The global optimization calculation is performed off-line yielding parameters A (output bin histogram), B (composition limits), and C (final bin weight).

Setup section 198 is performed in steps 200 to 202 to prepare for the sequential real-time sorting of pieces of material.

In steps 200 and 202 the bin specifications and the bin weight histogram are generated from the global optimization calculation. The histogram file (parameter A) is used to calculate a bin order for each piece of material in an input batch.

A sample of a portion of the histogram file is shown in Table 4 showing the first and last interval for each of seven output bins.

TABLE 4

| BIN | % FE | % MN | % MG | % SI | % ZN | % CU | INT |
|---|---|---|---|---|---|---|---|
| 1 | 0 | .1033 | .0455 | .0078 | .0793 | .3035 | 1 |
| | | (Intervals 2 to 125 not shown) | | | | | |
| 1 | 0 | 0 | 0 | 0 | 0 | 1.516 | 126 |
| 2 | 0 | .0991 | 0 | .0021 | .0270 | .0359 | 1 |
| | | (Intervals 2 to 125 not shown) | | | | | |
| 2 | 0 | 0 | 0 | 0 | 0 | 0 | 126 |
| 3 | .0039 | .0069 | 0 | .0020 | .1452 | .1075 | 1 |
| | | (Intervals 2 to 125 not shown) | | | | | |
| 3 | 0 | 0 | 0 | 0 | 0 | 0 | 126 |
| 4 | 0 | 0 | 0 | 0 | .0005 | 0 | 1 |
| | | (Intervals 2 to 125 not shown) | | | | | |
| 4 | 0 | 0 | 0 | 0 | 0 | .2246 | 126 |
| 5 | 0 | .0590 | .0001 | .0003 | .0135 | .0138 | 1 |
| | | (Intervals 2 to 125 not shown) | | | | | |
| 5 | 0 | 0 | 0 | 0 | 0 | .2246 | 126 |
| 6 | 0 | .0268 | 0 | 0 | .0082 | .0231 | 1 |
| | | (Intervals 2 to 125 not shown) | | | | | |
| 6 | 0 | 0 | 0 | 0 | 0 | 0 | 126 |
| 7 | 0 | .1820 | .0038 | 0 | .0259 | .0064 | 1 |
| | | (Intervals 2 to 125 not shown) | | | | | |
| 7 | 0 | 0 | 0 | 0 | 0 | 0 | 126 |

The output bin histogram (Table 4/Parameter A) represents the fraction of input batch weight that falls within the selected concentration interval of the given control element and which was directed to the given output bin by the global optimization calculation.

The output bin histogram is generated starting with the optimum output weight distribution among the output bins and the optimum distribution of the input unique compositions among the output bins. Both are provided by the off-line global optimization calculation using the table of input unique compositions and prescribed output compositions.

More specifically, Table 4 is generated by:

(a) adding a weight corresponding to a selected one of the unique compositions in the given output bin to a prescribed concentration interval that is equal to a prescribed concentration interval for a selected one of the control elements;

(b) repeating step (a) for each of the plurality of unique compositions in the given output bin;

(c) repeating steps (a) and (b) for each of the control elements; and (d) repeating steps (a), (b) and (c) for each of the output bins.

Each numerical value in Table 4 is the batch weight (%) indexed according to bin number (1 to 7), control element type (Fe, Mn, Mg, Si, Zn and Cu) and concentration interval (INT 1 to 126). Consequently, any control element column in the histogram file adds to 100%. The interval definitions are shown in Appendix A as discussed in conjunction with sorting method 95.

Each piece is assigned a bin order that is calculated in a bin order section 204 performed in steps 206 to 210. Composition information about a piece of material is provided from the LIBS analysis preformed at step 208.

This composition information is used in a piece statistic step 206 in which, the batch weights corresponding to the control element intervals of the current piece, in percent, are added together from the histogram file (Table 4) accumulating one sum per output bin. For example, for a designated piece in bins 1 to 7 (identified as "A") the total weight (%) for all six control elements is 3.16 for bin 1, 0.23 for bin 2, etc.

Table 5 provides an example of the output bin sums for two pieces.

TABLE 5

| Piece | OUTPUT BIN SUMS (%) | | | | | | |
|---|---|---|---|---|---|---|---|
| ID. | 1 | 2 | 3 | 4 | 5 | 6 | 7 |
| A | 3.16 | .23 | .38 | .02 | .22 | .81 | 0 |
| B | 3.64 | .45 | .22 | .14 | .59 | 1.34 | 0 |

The bin order is established at step 210 by following the descending order of element sums shown in Table 5 calculated from the histogram file (Table 4). Therefore, for piece A the bin order would be [1, 6, 3, 2, 5, 4, 7], and for piece B the bin order would be [1, 6, 5, 2, 3, 4, 7].

In general, the bin order section 204 allows output bins to be prioritized in order of the fraction of material of composition similar to the current piece that was placed in the given bin by the global optimization calculation. The bin that received most material with the same incoming piece composition is assigned first place in the bin order.

The specific target output bin for each piece is chosen in the sorting section 211 that includes steps 212 to 218. Each piece is subjected to a bin composition check at step 212 that operates with fixed limits for maximum target bin concentration and follows a variable bin order recalculated on a piece-by-piece basis as discussed in conjunction with FIG. 2 and Equation 1.

After a bin has accepted the piece (by satisfying Equation 1), data relating to the chosen bin is updated at step 214 to indicate that (a) another piece has been added to the bin; (b) the cumulative weight of the bin has increased accordingly; and (c) the new composition levels for the control elements.

At step 215 the unique composition table is updated as previously described in conjunction with step 115.

A decision step 216 returns control back to step 206 if another piece is to be sorted, or proceeds to step 218 to calculate a summary table of sorting activity if all of the pieces have been sorted.

Fixed Bin Order Method

Figure 4:
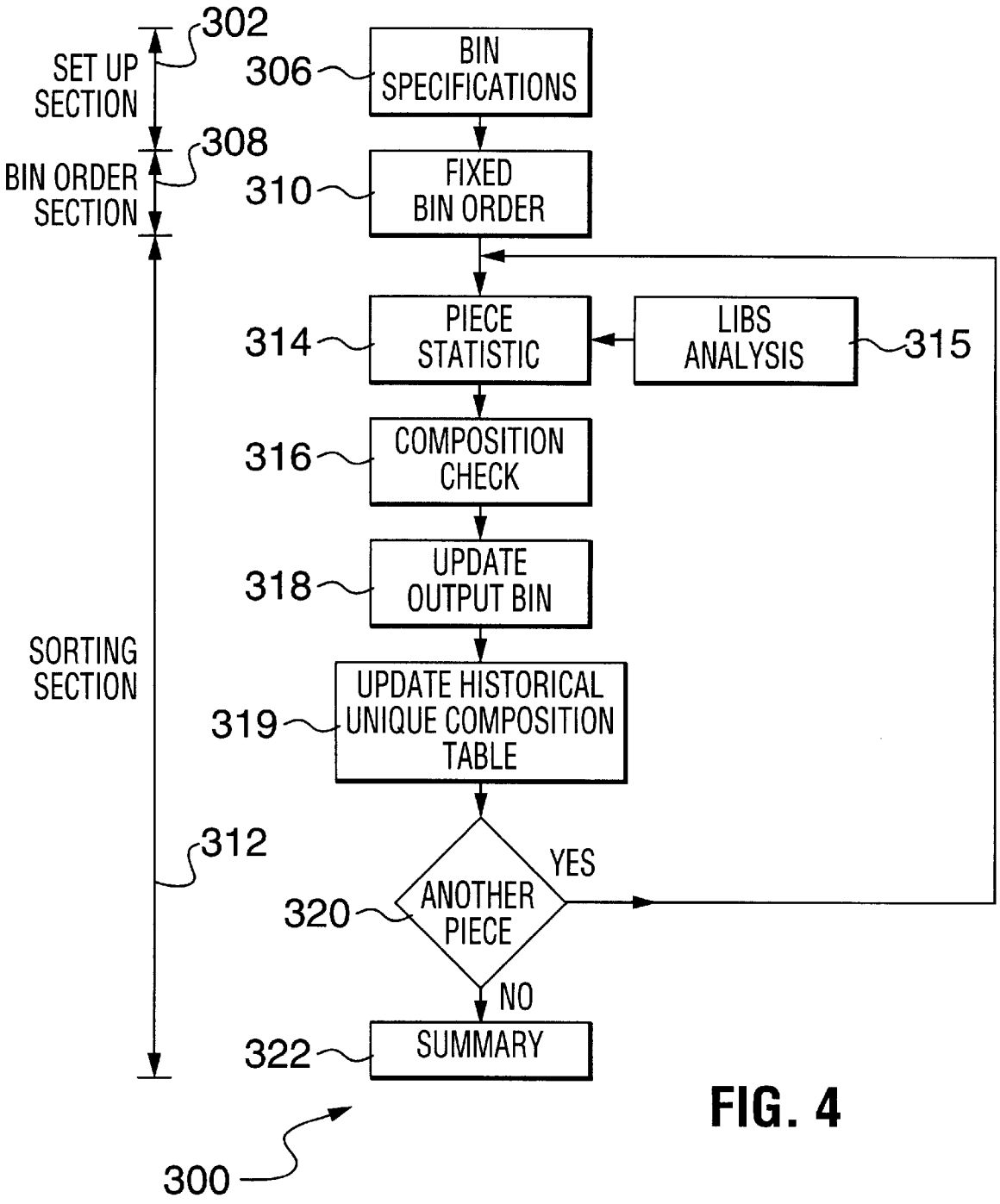
FIG. 4 represents a flow chart of fixed bin ordering methods according to an embodiment of the present invention.

Referring to FIG. 4, a sequential sorting method 300 according an embodiment of the present invention is illustrated in the form of a flow chart.

Setup section 302 is performed in step 306 to prepare for the sequential real-time sorting of pieces of material. Sorting method 300 uses parameters B (composition limit), and C (final bin weight).

Step 306 specifies the maximum allowable bin composition limits for the output bins. For example, the target compositions for bin 10, 12 and 14 could be defined as: bin 10: having the following concentration limits (in relative percentages): 0.4% Fe; 1.0% Mn; 0.3% Mg; 0.2% Si; 0.04% Zn; and 0.15% Cu; bin 12: having the following concentration limits: 0.26% Fe; 0.3% Mn; 1.6% Mg; 0.71% Si; 0.06% Zn; and 0.24% Cu; and bin 14: a residue bin with composition limits set artificially high (i.e. 99% for each control element).

The target weight distribution of a batch of scrap is also established at step 306, based on global optimization with customer demand input. For example, for a 20 ton input batch bin 10 could be set to 8 tons; bin 12 could be set to 7 tons; and bin 14 could be set to 5 tons. The relative values of the output products, in cents/lb below prime material cost are: bin 10: 5¢/lb; bin 12: 7¢/lb; and bin 14: 17¢/lb.

A bin order is established in bin order section 308 at step 310. The bin order remains fixed for all input material. The bin order step 310 could order the output bins by either (a) ascending output bin target weight or by (b) a modified version of order (a) in which high value alloys are given priority over target weight.

For example, using the bin specifications provided above, fixed bin order (a) would be [bin 10 (8 tons); bin 12 (7 tons); bin 14 (5 tons)]; and (b) would be [bin 12 (7 tons+5¢/lb below prime); bin 10 (8 tons+7¢/lb below prime); bin 14 (5 tons+17¢/lb below prime)]. Order (b) assigns a higher priority to bin 12 based on the higher value of the resulting alloy when compared to bin 10 even though bin 10 has a higher target weight.

A sorting section 312 includes steps 314 to 322 and are identical to like steps described in conjunction with methods 95 and 195 of FIGS. 2 and 3.

The inventors have found that the global optimization calculation tends to maximize the weight of the most highly alloyed, high value sorted output bin when used in conjunction with the fixed order method 300. Consequently, the fixed bin order is normally ranked according to the decreasing bin weights as assigned by the global optimization calculation. This, in most cases, corresponds to the increasing purity of the high value outputs. The most highly alloyed output bin is ranked first.

When the fixed bin order method 300 provides adequate results it eliminates the need for off-line optimization for each new type of input material. However, the inventors have found that the fixed order method 300 are not flexible enough to provide good sorting results in all cases.

In summary, the inventors have found that the fixed order method 300 (FIG. 4) can approach the global optimization results for specific combinations of input batch, bin order and output targets, but fail when conditions change. The more generic piece specific order methods 95 and 195 (FIGS. 2 and 3, respectively) are capable of approaching the global optimization results for arbitrary choices of input material and output targets.

Sorting method 95 can be used without off-line global optimization by assigning the target bin compositions and weights (Parameters B and C) according to arbitrary dilution levels. The sorting results for method 95 approach global optimum better, in most cases, than the fixed bin order methods 300. Sorting method 195 achieves a better solution than either method 95 or 300 due to the use of the global optimization information (the output bin histogram parameter A) in the choice of the bin order.

EXAMPLE 1

The present example illustrates the performance differences of the fixed bin order method and the variable bin order methods discussed above relative to optimised sorting using a simulated batch of aluminum scrap metal.

Sorting method 95: Piece specific bin order; using parameters B, C and D. (FIG. 2)

Sorting method 195: Piece specific bin order; using parameters A, B and C. (FIG. 3)

Sorting method 300: Fixed bin order; using parameters B and C. (FIG. 4)

Parameter use is summarized as follows:

Parameters used for calculating bin order (once per scrap piece): method 95—parameter D; method 195—parameter A; and method 300—fixed; and Parameters used for composition testings (once per scrap piece): methods 95, 195, and 300—parameter B.

All sequential sorting methods (95, 195, 300) sort by calculating (using Equation 1) whether or not the incoming piece will cause current bin composition to exceed the maximum bin composition limit for any of the six control elements (Fe, Mn, Mg, Si, Zn, and Cu). The piece is accepted by the first bin that remains below maximum composition limits assuming the piece were already added to the bin.

The difference between the four methods is how each method orders or prioritizes the bins for composition checking. Since the first bin that passes the composition test receives the piece, calculation of the bin priority is important to accurately approximate the results of optimised sorting.

For the present example the batch of pieces for sorting was simulated using a table of random piece weights (between 1 and 110 grams) each piece was randomly assigned a piece composition. Piece compositions originated from over 4 tonnes of scrap sampled from over 20 tonnes of scrap.

Performance of the sequential sorting methods (95, 195, 200) is judged by comparison to determine how closely each method matches optimised sorting in terms of distribution of weights between the different output bins and in terms of the final composition of the output bins.

The target output bin composition limits for each of the alloys are shown in Table E1.

TABLE E1

| BIN No. | % Fe | % Mn | % Mg | % Si | % Zn | % Cu |
|---|---|---|---|---|---|---|
| 1 | .40 | 1.0 | .3 | .2 | .04 | .15 |
| 2 | .380 | .88 | 1.6 | .2 | .05 | .19 |
| 3 | .21 | .30 | 4.85 | .11 | .05 | .04 |
| 4 | .26 | .03 | 1.6 | .71 | .06 | .24 |
| 5 | .26 | .48 | 1.0 | 1.01 | .05 | .1 |
| 6 | .45 | .33 | 1.0 | 7.4 | .3 | .2 |
| 7 | 99 | 99 | 99 | 99 | 99 | 99 |

Table E2 illustrates that method 195 is better than methods 95 and 300 at approximating the optimum target weight distribution.

TABLE E2

| BIN # | Sorting Method 95 | Sorting Method 195 | Sorting Method 300 | OPTIMUM (wt %) |
|---|---|---|---|---|
| 1 | 19.3 | 29.4 | 29.8 | 38.9 |
| 2 | 11.1 | 12.7 | 21.8 | 6.8 |
| 3 | 3.3 | 3.5 | 0.3 | 11.4 |
| 4 | 4.1 | 0 | 7.6 | 0.7 |
| 5 | 16.2 | 9.9 | .01 | 7.1 |
| 6 | 9.9 | 11.6 | 10.3 | 6.6 |
| 7 | 36.2 | 32.9 | 30.1 | 28.5 |
| AVG. DIFF. Wt % | 7.9 | 5.2 | 7.8 | n/a |

Table E3 illustrates that using either one of the bin ordering methods the bin compositions are purer than the target in all but one or two control elements as required by the composition check step. Although composition differences are small, in general, method 195 approaches the target composition closer than methods 95 and 300. This has a large impact on how closely these methods approach the optimum weight distribution in Table E2.

The present example illustrates the case where the fixed bin order 300 provides good results: equivalent or better than method 95, but in general that would not be the case.

TABLE E3

| BIN | Sorting | Fe | Mn | Mg | Si | Zn | Cu |
|---|---|---|---|---|---|---|---|
| 1 | optimum | .4 | 1 | .3 | .2 | .004 | .15 |
| | 95 | .4 | .441 | .182 | .2 | .039 | .07 |
| | 195 | .4 | .399 | .299 | .2 | .038 | .062 |
| | 300 | .4 | .403 | .3 | .2 | .038 | .062 |
| 2 | optimum | .38 | .88 | 1.6 | .2 | .05 | .19 |
| | 95 | .38 | .325 | 1.57 | .2 | .048 | .123 |
| | 195 | .38 | .255 | 1.57 | .199 | .048 | .074 |
| | 300 | .379 | .289 | 1.5 | .2 | .047 | .073 |
| 3 | optimum | .21 | .3 | 4.85 | .11 | .05 | .04 |
| | 95 | .207 | .069 | 1.56 | .097 | .04 | .018 |
| | 195 | .207 | .102 | 1.88 | .106 | .045 | .031 |
| | 300 | .209 | .121 | 2.01 | .109 | .004 | .037 |
| 4 | optimum | .26 | .03 | 1.6 | .71 | .06 | .24 |
| | 95 | .259 | .017 | 1.58 | .139 | .049 | .016 |
| | 195 | 0 | 0 | 0 | 0 | 0 | 0 |
| | 300 | .26 | .028 | .943 | .705 | .050 | .079 |
| 5 | optimum | .26 | .48 | 1 | 1.01 | .05 | .1 |
| | 95 | .26 | .06 | .976 | .759 | .046 | .039 |
| | 195 | .26 | .094 | .989 | .946 | .043 | .056 |
| | 300 | .258 | .249 | .762 | .913 | .007 | .036 |
| 6 | optimum | .45 | .33 | 1 | 7.4 | .3 | .2 |
| | 95 | .45 | .292 | .937 | .819 | .287 | .181 |
| | 195 | .45 | .282 | .972 | .931 | .29 | .197 |
| | 360 | .45 | .277 | .947 | 1.29 | .281 | .198 |
| 7 | optimum | 99 | 99 | 99 | 99 | 99 | 99 |
| | 95 | .79 | .456 | .552 | 3.26 | .937 | .967 |
| | 195 | .784 | .404 | .640 | 3.53 | 1.02 | 1.05 |
| | 300 | .798 | .377 | .604 | 3.86 | 1.12 | 1.13 |

DEFINING INTERVALS FOR ELEMENT HISTOGRAMS
By Range Covered, Affected Elements, Width, Number and Minimum Concentration

| 0–2.5 Range Fe, Mn, Mg, Si, Cu, Zn Interval Width = 0.025% | | | | | | | | 2.5–5 Range Fe, Mn, Cu Width = 0.1% | | 2.5–10 Range Mg, Zn Width = 0.3% | | 2.5–27.5 Range Si Width = 1.0% | |
|---|---|---|---|---|---|---|---|---|---|---|---|---|---|
| No. | MIN | No. | MIN | No. | MIN | No. | MIN | No. | MIN | No. | MIN | No. | MIN |
| 1 | 0.000% | 25 | 0.600% | 50 | 1.225% | 75 | 1.850% | 101 | 2.5% | 101 | 2.5% | 101 | 2.5% |
| 2 | 0.025% | 26 | 0.625% | 51 | 1.250% | 76 | 1.875% | 102 | 2.6% | 102 | 2.8% | 102 | 3.5% |
| 3 | 0.050% | 27 | 0.650% | 52 | 1.275% | 77 | 1.900% | 103 | 2.7% | 103 | 3.1% | 103 | 4.5% |
| 4 | 0.075% | 28 | 0.675% | 53 | 1.300% | 78 | 1.925% | 104 | 2.8% | 104 | 3.4% | 104 | 5.5% |
| 5 | 0.100% | 29 | 0.700% | 54 | 1.325% | 79 | 1.950% | 105 | 2.9% | 105 | 3.7% | 105 | 6.5% |
| 6 | 0.125% | 30 | 0.725% | 55 | 1.350% | 80 | 1.975% | 106 | 3.0% | 106 | 4.0% | 106 | 7.5% |
| 7 | 0.150% | 31 | 0.750% | 56 | 1.375% | 81 | 2.000% | 107 | 3.1% | 107 | 4.3% | 107 | 8.5% |
| 8 | 0.175% | 32 | 0.775% | 57 | 1.400% | 82 | 2.025% | 108 | 3.2% | 108 | 4.6% | 108 | 9.5% |
| 9 | 0.200% | 33 | 0.800% | 58 | 1.425% | 83 | 2.050% | 109 | 3.3% | 109 | 4.9% | 109 | 10.5% |
| 10 | 0.225% | 34 | 0.825% | 59 | 1.450% | 84 | 2.075% | 110 | 3.4% | 110 | 5.2% | 110 | 11.5% |
| 11 | 0.250% | 35 | 0.850% | 60 | 1.475% | 85 | 2.100% | 111 | 3.5% | 111 | 5.5% | 111 | 12.5% |
| 12 | 0.275% | 36 | 0.875% | 61 | 1.500% | 86 | 2.125% | 112 | 3.6% | 112 | 5.8% | 112 | 13.5% |
| 13 | 0.300% | 37 | 0.900% | 62 | 1.525% | 87 | 2.150% | 113 | 3.7% | 113 | 6.1% | 113 | 14.5% |
| 14 | 0.325% | 38 | 0.925% | 63 | 1.550% | 88 | 2.175% | 114 | 3.8% | 114 | 6.4% | 114 | 15.5% |
| 15 | 0.350% | 39 | 0.950% | 64 | 1.575% | 89 | 2.200% | 115 | 3.9% | 115 | 6.7% | 115 | 16.5% |
| 16 | 0.375% | 40 | 0.975% | 65 | 1.600% | 90 | 2.225% | 116 | 4.0% | 116 | 7.0% | 116 | 17.5% |
| 17 | 0.400% | 41 | 1.000% | 66 | 1.625% | 91 | 2.250% | 117 | 4.1% | 117 | 7.3% | 117 | 18.5% |
| 18 | 0.425% | 42 | 1.025% | 67 | 1.650% | 92 | 2.275% | 118 | 4.2% | 118 | 7.6% | 118 | 19.5% |
| 19 | 0.450% | 43 | 1.050% | 68 | 1.675% | 93 | 2.300% | 119 | 4.3% | 119 | 7.9% | 119 | 20.5% |
| 20 | 0.475% | 44 | 1.075% | 69 | 1.700% | 94 | 2.325% | 120 | 4.4% | 120 | 8.2% | 120 | 21.5% |
| 21 | 0.500% | 45 | 1.100% | 70 | 1.725% | 95 | 2.350% | 121 | 4.5% | 121 | 8.5% | 121 | 22.5% |
| 22 | 0.525% | 46 | 1.125% | 71 | 1.750% | 96 | 2.375% | 122 | 4.6% | 122 | 8.8% | 122 | 23.5% |
| 23 | 0.550% | 47 | 1.150% | 72 | 1.775% | 97 | 2.400% | 123 | 4.7% | 123 | 9.1% | 123 | 24.5% |
| 24 | 0.575% | 48 | 1.175% | 73 | 1.800% | 98 | 2.425% | 124 | 4.8% | 124 | 9.4% | 124 | 25.5% |
| 25 | 0.600% | 49 | 1.200% | 74 | 1.825% | 99 | 2.450% | 125 | 4.9% | 125 | 9.7% | 125 | 26.5% |
| | | 50 | 1.225% | 75 | 1.850% | 100 | 2.475% | 126 | 5.0% | 126 | 10.0% | 126 | 27.5% |

We claim:

1. A method of sequentially sorting an input batch of pieces of material each having a composition defined by at least one control element, each of said pieces having a concentration for each of the control elements and a weight, said sorting being from the input batch into a plurality of output bins each assigned a target concentration for each of the control elements, pieces in each of said output bins having a cumulative aggregate weight and an aggregate concentration for each of the control elements, comprising the steps of:

(a) establishing a bin order for a selected one of said pieces;

(b) calculating in the bin order an aggregate composition of the output bins after the addition of said selected piece;

(c) placing the selected piece in a selected bin, said selected bin being the first bin for which the new aggregate composition falls within the target concentration limits for all the control elements; and (d) repeating steps (a) to (c) for each subsequent piece in the input batch.

2. A method according to claim 1, wherein the step of calculating is carried out in accordance with a composition check equation:

$$C_{piece}W_{piece}+C_{bin,actual}W_{bin}=C_{bin,max}(W_{piece}+W_{bin})$$

where:

$C_{piece}$ is the concentration for each control element;

$W_{piece}$ is the estimated weight of each piece;

$C_{bin,actual}$ is the actual concentration for each control element for each bin;

$W_{bin}$ is the aggregate weight of each bin; and $C_{bin,max}$ is the target concentration for each control element for each bin.

3. A method according to claim 1, wherein the bin order is the same for all of the pieces in the input batch.

4. A method according to claim 3, further comprising the step of assigning a weight target to each of the bins, and wherein the bin order is established by ranking the bins in descending order of weight target.

5. A method according to claim 3, further comprising the step of assigning a weight target and a value to each of the bins, and wherein the bin order is established by ranking the bins primarily in descending order of weight target and secondarily in descending order of value.

6. A method according to claim 1, further comprising the step of generating a batch weight histogram indicating the distribution of input batch weight as a function of control element concentration based on historical composition data that provides a weight distribution table of a plurality of unique compositions of the control elements from an input batch closely matching the input batch to be sorted, and wherein the bin order is established by ranking the bins according information obtained from said batch weight histogram.

7. A method according to claim 6, wherein the step of establishing a batch weight histogram includes the steps of:

(a) adding a weight corresponding to a selected one of said unique compositions to a plurality of prescribed concentration intervals that are equal or greater than a prescribed concentration level for a selected one of said control elements;

(b) repeating step (a) for each of the plurality of unique compositions; and (c) repeating steps (a) and (b) for each of the control elements.

8. A method according to claim 6, wherein the bin order is established to minimize undershooting and overshooting of the target aggregate concentration for each of the control elements for each of the output bins.

9. A method according to claim 1, further comprising the step of establishing an output bin histogram indicating the distribution of input batch weight as a function of control element concentration in each of the output bins based on historical composition data that provides a weight distribution table of a plurality of unique compositions of the control elements from an input batch closely matching the input batch to be sorted, and wherein the bin order is established by ranking the bins according to information obtained from said output bin histogram.

10. A method according to claim 8, wherein the step of establishing an output bin histogram includes the steps of:

(a) adding a weight corresponding to a selected one of said unique compositions in the given output bin to a prescribed concentration interval that is equal to a prescribed concentration interval for a selected one of said control elements;

(b) repeating step (a) for each of the plurality of unique compositions in the given output bin;

(c) repeating steps (a) and (b) for each of the control elements; and (d) repeating steps (a), (b) and (c) for each of the output bins.

11. A method of sequentially sorting an input batch of pieces of material each having a composition defined by at least one control element, each of said pieces having a concentration for each of the control elements and a weight, said sorting being from the input batch into a plurality of output bins based on a plurality of predetermined sequential sort parameters, comprising the steps of:

(a) establishing a bin order for a current one of said pieces;

(b) calculating in the bin order an aggregate composition of the output bins after the addition of said current piece;

(c) placing the current piece in a bin for which the new aggregate composition falls within limits established by the sequential sort parameters; and (d) repeating steps (a) to (c) for all subsequent pieces.

12. A method according to claim 11 wherein said sequential sort parameters are based on data selected from the group consisting of: customer output demands, historical composition data, and global optimization from a similar batch of input material.

13. A method according to claim 12, wherein said sequential sort parameters include a target bin composition, and a target final bin weight for each of said output bins.

14. A method according to claim 13, wherein said sequential sort parameters include a batch weight histogram showing the distribution of batch weight as a function of control element concentration.

15. A method according to claim 13, wherein said sequential sort parameters additionally include a plurality of output bin histograms showing the distribution of batch weight as a function of control element concentration in each of the output bins as predicted by global optimization.

* * * * *